US008673402B2

(12) United States Patent
Branagan

(10) Patent No.: US 8,673,402 B2
(45) Date of Patent: Mar. 18, 2014

(54) SPRAY CLAD WEAR PLATE

(75) Inventor: Daniel James Branagan, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 762 days.

(21) Appl. No.: 12/268,275

(22) Filed: Nov. 10, 2008

(65) Prior Publication Data

US 2009/0123765 A1 May 14, 2009

Related U.S. Application Data

(60) Provisional application No. 60/986,724, filed on Nov. 9, 2007.

(51) Int. Cl.
*B05D 1/02* (2006.01)

(52) U.S. Cl.
USPC ..... 427/427; 420/12; 420/34; 420/127; 427/451; 427/456

(58) Field of Classification Search
USPC ..... 420/8–15, 33–34; 427/421.1, 427, 450, 427/451, 455, 456
See application file for complete search history.

(56) References Cited

U.S. PATENT DOCUMENTS

| | | | | |
|---|---|---|---|---|
| 4,036,671 | A * | 7/1977 | De Haeck | 148/24 |
| 4,152,144 | A * | 5/1979 | Hasegawa et al. | 148/304 |
| 4,804,034 | A * | 2/1989 | Leatham et al. | 164/46 |
| 5,015,439 | A * | 5/1991 | Tyler et al. | 419/23 |
| 6,174,386 | B1 * | 1/2001 | Delblanc-Bauer et al. | 148/325 |
| 6,298,900 | B1 | 10/2001 | Pergande et al. | |
| 6,443,723 | B1 * | 9/2002 | Buttigieg | 425/214 |
| 2005/0000673 | A1 * | 1/2005 | Branagan | 164/98 |
| 2005/0084407 | A1 * | 4/2005 | Myrick | 419/66 |
| 2006/0165551 | A1 * | 7/2006 | Kapoor et al. | 420/69 |
| 2006/0180252 | A1 * | 8/2006 | Branagan et al. | 148/561 |

* cited by examiner

*Primary Examiner* — Alexander Weddle
(74) *Attorney, Agent, or Firm* — Grossman, Tucker, Perreault & Pfleger, PLLC

(57) ABSTRACT

The present disclosure relates to a method of spray cladding a wear plate. The method may include melting an alloy including glass forming chemistry, pouring the alloy through a nozzle to form an alloy stream, forming droplets of the alloy stream, and forming a coating of the alloy on a base metal. The base plate may exhibit a first hardness $H_1$ of Rc 55 or less and the alloy coated base plate may exhibit a hardness $H_2$, wherein $H_2>H_1$. In addition, the coating may exhibit nanscale or near-nanscale microstructural features in the range of 0.1 nm to 1,000 nm. Furthermore, the alloy coated base plate may exhibit a toughness of greater than 60 ft-lbs.

11 Claims, No Drawings

SPRAY CLAD WEAR PLATE

CROSS REFERENCE TO RELATED APPLICATIONS

The present application claims the benefit of the filing date of U.S. Provisional Application No. 60/986,724 filed Nov. 9, 2007, the teachings of which are incorporated herein by reference.

FIELD OF INVENTION

The present disclosure relates to a method for providing dual hardness plates for high wear applications.

BACKGROUND

Wear plates for high wear applications may commonly be manufactured by two methods and may form distinct types of wear plates, including: monolithic steel plates and weld overlay steel plates. While, wear plate sizes may depend somewhat on the manufacturing technique and specific application, they may generally be formed in the range of 0.1875" (4.8 mm) to 2.0" (50.8 mm) in thickness with widths from 48" to 96" and lengths from 120" to 288". Wear plates may also be provided in flat sheet form or may be cut, drilled and bent into shapes to match a preexisting part or application. Often wear plates may be custom fit and tack welded onto the substrate of a machine or other device to act as a sacrificial wear part that may be replaced as needed.

Monolithic steel plates may be analogous to conventional steel sheet, having similar production methods. Traditionally, the monolithic steel plates may be produced through continuous casting processes followed by several stages of hot or cold rolling to achieve the targeted thickness. Often complex multi-step heat treatments may be necessary to achieve the targeted properties, which may involve quenching, tempering, and aging steps. Monolithic steel plates may be manufactured by a number of companies such as Brinell or Hardox in various grades achieving hardness from Rc 35 to 55, including all values and increments therein. Wear plates of this class may generally be used in high volume applications, where exposure to impact may be low, or in cost sensitive applications, where cost may be a main selection driver.

Weld overlay wear plates may be made by applying a continuous weld overlay onto a pre-existing steel substrate. Several variations of weld overlay application techniques are commercially available, including gas metal arc-welding (GMAW), open arc welding (i.e. no cover gas), plasma transferred arc-welding (PTAW), submerged arc-welding, and powder feed submerged arc welding using a solid electrode. The various processes may commonly use a variety of feedstock wires sized from 0.045" (1.2 mm) to ⅛" (3.2 mm) in diameter, including all values and increments therein, and feedstock powders ranging from 45 microns up to 300 microns in size, including all values and increments therein. Generally, the weld overlays may be applied in a single pass, double pass, or up to triple pass, weld overlay plates may be used for some high wear application. Typically, the weld overlay thickness may be as thick as the base metal. For example, a ⅜" thick weld overlay may be applied to a ⅜" thick base steel for a total plate thickness of ¾". Typical base steels may include low carbon or low cost steel alloys such as A36 or 1018 steel, although in some cases, high end monolithic steel grades may be used. A number of manufacturers currently produce weld overlay wear plates including Hardware, Cronatron, and Castolin Eutectic, using a variety of materials including nickel base alloys with and without hardmetals such as tungsten carbide, chrome carbides, complex carbides, and WC containing nickel, cobalt, or steel alloys. Wear plates of this class may generally be utilized for severe wear environments, higher impact applications, or where cost is not a primary issue, as compared to machine downtime.

SUMMARY

An aspect of the present disclosure relates to a method of spray cladding a wear plate. The method may include melting an alloy including glass forming chemistry, pouring the alloy through a nozzle to form an alloy stream, forming droplets of the alloy stream, and forming a coating of the alloy on a base metal.

Another aspect of the present disclosure relates to a spray clad wear plate. The spray clad wear plate may include a base plate and an alloy coating including glass forming chemistry disposed on the base plate. The base plate may exhibit a first hardness $H_1$ of Rc 55 or less and the alloy coated base plate may exhibit a hardness $H_2$, wherein $H_2>H_1$. In addition, the coating may exhibit nanscale or near-nanscale microstructural features in the range of 0.1 nm to 1,000 nm. Furthermore the alloy coated base plate may exhibit a toughness of greater than 60 ft-lbs.

DETAILED DESCRIPTION

Contemplated herein is a method of wear plate manufacturing including spray metal cladding. In this case, the spray cladding may be applied by a relatively rapid spray metal forming technique onto a conventional base material such as plates formed of steel, aluminum, titanium, etc. The resultant dual hardness material system may potentially exhibit relatively high hardness and wear resistance in the outer layer of the spray metal cladding while the base material may provide relatively high toughness. Such wear plates may be utilized in various applications including mining, heavy construction or armor plate for military applications.

In a general aspect, the method contemplates providing iron based glass forming steels as the spray metal cladding onto conventional base metals such as low cost steel like A36, 1008, 1018, as well as aluminum, aluminum alloys, titanium, titanium alloys, etc. The approach would be expected to work with any iron based glass forming alloy. Glass forming alloys or glass forming chemistries may be understood as alloy compositions that may be capable of forming relatively amorphous compositions. That is, the compositions may include crystalline structures or atomic associations on the order of less than 1 μm in size, including all values and increment in the range of 0.1 nm to 100 μm, 0.1 nm to 1,000 nm, etc. In addition, the alloy may include at least 40% metallic glass, wherein crystalline structures or relatively ordered atomic associations may be present in the range of 0.1 to up 60% by volume.

Examples of glass forming chemistries may include an iron based alloys, wherein iron may be present at least 55 atomic % (at %). The alloy may also include or consist of at least one transition metal selected from the group consisting of Ti, Zr, Hf, V, Ta, Cr, Mo, W, Al, Mn, Ni or combinations thereof present in the range of 5 at % to 30 at %, at least one non/metal or metalloid selected from the group consisting of B, C, N, O, P, Si, S, or combinations thereof present in the range of 5 at % to 30 at %, and niobium present in the range of 0.01 at % to 10 at %.

Other examples of alloy chemistries include metallic alloy compositions including or consisting of greater than 55 at % of iron, in the range of 0 to 16 at % chromium, in the range of 0.5 to 6 at % niobium, in the range of 12 to 23 at % boron, in the range of 0 to 10% vanadium, and in the range of 0 to 9 at % carbon. Specific examples of these alloy chemistries may, therefore, include $Fe_{60.5}Mn_1Cr_9Nb_4V_7B_{13.2}C_{4.8}Si_{0.5}$ and $Fe_{65.5}Mn_{0.1}Nb_{4.2}V_{7.3}B_{19.3}C_{2.9}Si_{0.7}$. However, it may be appreciated that other chemistries falling within the scope of the example formulations may be considered herein. In addition, the resulting alloy may include greater than 20% of ferrite by volume of the resulting alloy, including all values and increments in the range of 20% to 80% by volume ferrite, 25-75% by volume ferrite or 30-50% by volume ferrite.

Spray cladding may be used to deposit the coating alloy described above onto a base metal. Spray cladding may be understood as a derivation of the spray forming process, wherein coatings may be formed over substrate surfaces by melting the coating alloy and pouring the alloy through a nozzle. The alloy may exit the nozzle in a stream and may be broken into droplets by a gas jet. The gas jet may propel the molten droplets toward the surface of the substrate, wherein the droplets may land on the surface in a semi-solid state. It may be appreciated that in addition to the use of gas jet droplet formation, centrifugal atomization may be utilized as well, wherein the centrifugal force propels the droplets towards the surface of the substrate. The process may produce a coating having low porosity and a density in the range of 95 to 99.5% of the initial alloy. As deposition continues a coating layer may be built up upon the substrate.

The process may include a relatively rapid solidification process, with individual splats cooling at rates of up to 20,000 K/s. Splats may be understood as droplets that may contact the base metal surface either directly or indirectly during the coating process and may deform upon impacting the surface. This relatively fast cooling may make it relatively easier to achieve high undercooling to produce near nanoscale structures and to produce sufficient undercooling to cool directly into a glass structure which may or may not devitrify into a nanoscale composite structure as the spray deposit heats. Undercooling may be understood as the lowering of the temperature of a liquid beyond the freezing temperature and still maintaining a liquid form. If the level of undercooling obtained is below the fictive glass temperature, Tg, then a metallic glass structure may be achieved. The fictive temperature may be understood as the thermodynamic temperature at which the glass structure may be in equilibrium.

Note that as the spray deposit heats up from continuous metal deposition, the cooling rate of the deposit may be reduced, resulting in a secondary cooling stage, which may cool at a much slower rate than the initial cooling rate and may be less crucial to microstructural formation. Additionally, it is noted that the spray forming process may begin with a liquid melt. Beginning with a liquid melt bypasses the first step of forming a plate from glass forming steel, which may then be subsequently roll bonded directly onto a conventional backing plate steel, during the production of a dual hardness plate. Thus, in bypassing the first stage of plate production, a commercially viable route for large stage production may be possible by spray cladding directly from a commercial melt.

With respect to monolithic steel plate, the spray cladding approach offers the advantage that much higher hardness and/or wear resistance may be obtained. In conventional steel or the base metals, as hardness is increased, there may be a corresponding decrease in toughness. This exchange in properties may limit the application of monolithic steel plate. However, the spray clad plates may develop relatively high hardness $H_2$, which may in some examples be in the range of Rc 55 to Rc 75, including all values and increments therein; whereas the base metal may exhibit a hardness $H_1$ of Rc 55 or less, including all values and increments therein, such as a hardness of Rc 1 to Rc 55, Rc 10 to Rc 40, Rc 35 to Rc 55, etc., wherein $H_1<H_2$. The spray clad plates may also develop relatively high wear resistance from the spray metal clad material which contains nanoscale or near-nanoscale microstructural features while the base material provides the toughness desired for the resulting material system. Nanoscale or near-nanoscale microstructural features may be understood as atomic associations in the range of 0.1 nm to 1,000 nm, including all values and increments therein. In addition, a relatively high toughness, i.e., >60 ft-lbs in unnotched Charpy impact at room temperature, including all values and increments in the range of 60 to 200 ft-lbs may be obtained without failure when glass forming steel alloys are applied to conventional backing steel or other base metals.

In addition, it may be appreciated that the production rates of spray forming/cladding may be relatively greater than those found in conventional weld overlay approaches toward forming wear plate. For example, in producing weld overlay wear plate by submerged arc welding using a large diameter wire such as 7/64", the welding rate may be approximately 30 lb/hr per welding torch. On a high volume wear plate weld overlay table using four robotically controlled welding heads, this may then result in a production rate of 120 lb/hr. In contrast, spray forming may approach a higher deposition process with production rates of 60 lb/minute per nozzle. For a two nozzle system, spray cladding production rates may be 120 lb/minute or 7,200 lb/hr and for a conceptual four nozzle process production rates may be 240 lb/minute or 14,400 lb/hr. Thus, spray metal clad plate may offer a potential 120 fold production rate over existing approaches to produce weld overlay wear plate.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A method of spray cladding a wear plate, comprising:

melting an alloy including glass forming chemistry, wherein said alloy exhibits a first density $\rho_1$ prior to melting and said alloy comprises iron present at greater than 55 atomic percent, chromium present in the range of 0 to 16 atomic percent, niobium present in the range of 0.5 to 6 atomic percent, boron present in the range of 12 to 23 atomic percent, vanadium present in the range of 7 to 10 atomic percent, and carbon present in the range of 0 to 9 atomic percent;

pouring said alloy through a nozzle to form an alloy stream;

forming droplets of said alloy stream, wherein said droplets land on a base plate in a semi-solid state; and forming a coating with said droplets on said base plate;

wherein said coating exhibits a second density $\rho_2$, wherein said second density $\rho_2$ is in the range of 95.0 to 99.5% of said first density $\rho_1$, and said coating of said alloy contains at least 40 percent by volume metallic glass and up to 60 percent by volume crystalline structures, wherein said crystalline structures include greater than 20 percent by volume of ferrite.

2. The method of claim 1, wherein said droplets are formed by a gas jet.

3. The method of claim 1, wherein said droplets are formed by centrifugal atomization.

4. The method of claim 1, wherein said alloy cools at a rate of up to 20,000 K/second.

5. The method of claim 1, wherein said alloy comprises $Fe_{60.5}Mn_1Cr_9Nb_4V_7B_{13.2}C_{4.8}Si_{0.5}$.

6. The method of claim 1, wherein said alloy comprises $Fe_{65.5}Mb_{0.1}Nb_{4.2}V_{7.3}B_{19.3}C_{2.9}Si_{0.7}$.

7. The method of claim 1, wherein said base plate exhibits a hardness $H_1$ of Rc 55 or less.

8. The method of claim 7, wherein said coating on said base plate exhibits a hardness $H_2$, wherein $H_2>H_1$ and $H_2$ is in the range of Rc 55 to Rc 75.

9. The method of claim 1, wherein said coating exhibits nanoscale or near-nanoscale microstructural features in the range of 0.1 nm to 1,000 nm.

10. The method of claim 1, wherein said alloy coated base plate exhibits a toughness of greater than 60 ft-lbs.

11. The method of claim 1, wherein said coating is formed at a rate of greater than 30 lb per hour.

* * * * *